US007946392B2

(12) United States Patent
Rotboll

(10) Patent No.: US 7,946,392 B2
(45) Date of Patent: May 24, 2011

(54) DRIVE FOR AN ELEVATOR DOOR WITH A DISPLACEMENT CURVE ADAPTED TO THE AIR FLOWS IN THE SHAFT

(75) Inventor: Esben Rotboll, Zug (CH)

(73) Assignee: Inventio AG, Hergiswil NW (CH)

( * ) Notice: Subject to any disclaimer, the term of this patent is extended or adjusted under 35 U.S.C. 154(b) by 666 days.

(21) Appl. No.: 11/813,702

(22) PCT Filed: Jan. 6, 2006

(86) PCT No.: PCT/CH2006/000012

§ 371 (c)(1),
(2), (4) Date: May 27, 2008

(87) PCT Pub. No.: WO2006/074563

PCT Pub. Date: Jul. 20, 2006

(65) Prior Publication Data

US 2009/0050416 A1 Feb. 26, 2009

(30) Foreign Application Priority Data

Jan. 11, 2005 (EP) ..... 05405010

(51) Int. Cl.
*B66B 13/14* (2006.01)

(52) U.S. Cl. ..... 187/316; 187/391

(58) Field of Classification Search ..... 187/313, 187/316, 317, 293, 296, 297, 391–393; 318/59, 318/66, 69, 71, 280–286, 466–470, 471, 472, 481; 49/26, 28, 31, 100, 118, 138
See application file for complete search history.

(56) References Cited

U.S. PATENT DOCUMENTS

| | | | | |
|---|---|---|---|---|
| 2,992,818 | A * | 7/1961 | Berkovitz et al. | 187/316 |
| 3,605,952 | A * | 9/1971 | Lusti | 187/319 |
| 3,822,767 | A * | 7/1974 | Lowry | 187/316 |
| 4,592,270 | A * | 6/1986 | Vener | 454/68 |
| 6,021,871 | A | 2/2000 | Grabner et al. | |
| 6,938,382 | B2 * | 9/2005 | Schmitz | 52/89 |
| 7,665,930 | B2 * | 2/2010 | Kennedy et al. | 405/144 |
| 2005/0000057 | A1 * | 1/2005 | Tsekhanovsky et al. | 16/79 |
| 2009/0034187 | A1 * | 2/2009 | Coles et al. | 361/687 |

FOREIGN PATENT DOCUMENTS

| | | |
|---|---|---|
| EP | 0 548 505 61 | 6/1993 |
| JP | 02 028490 A | 1/1999 |

* cited by examiner

*Primary Examiner* — Jonathan Salata
(74) *Attorney, Agent, or Firm* — Fraser Clemens; Martin & Miller LLC; William J. Clemens

(57) ABSTRACT

A method of operating an elevator installation and the elevator installation include elevator doors actuated by an elevator drive according to a travel curve. At least one sensor unit detects pressure relationships and/or air flows. An evaluating unit determines a travel curve, which is optimal with respect to the detected pressure relationships and/or air flows, from a plurality of travel curves.

14 Claims, 5 Drawing Sheets

DRIVE FOR AN ELEVATOR DOOR WITH A DISPLACEMENT CURVE ADAPTED TO THE AIR FLOWS IN THE SHAFT

FIELD OF THE INVENTION

This invention relates to a method of operating an elevator installation as well as to such an elevator installation. The elevator doors of the elevator installation are actuated by a door drive by way of a travel curve.

BACKGROUND OF THE INVENTION

Elevator doors usually consist of a car door, which is connected with an elevator car, and a plurality of shaft doors, which are arranged on floors of a building and afford access to the shaft of the elevator. On opening and closing, the car door and the shaft door are connected together by way of a coupling and moved in common by the door drive mounted on the elevator car.

Elevator doors as used in, for example, high-speed elevators, have to meet various preconditions. Thus, shortest possible door closing times are desired by customers so as to achieve high levels of transport performance. The document EP 0 548 505 B1 discloses a method for rapid opening and closing of the elevator doors in accordance with a travel curve. The travel curve contains data about duration and speed of the opening and closing of the elevator doors as well as with respect to kinetic energy of the elevator doors during these processes. Depending on the respective wind conditions prevailing in the shaft, the elevator doors can close with greater or lesser expenditure of force and time, which impairs the transport performance.

U.S. Pat. No. 3,822,767A teaches detection of the wind speed prevailing in the shaft and a proportional adaptation of the magnitude of the closing force of the door drive, which moves the elevator doors, to the strength of the wind speed prevailing in the shaft.

A travel curve, in fact, usually consists of several phases and, in particular, of an acceleration phase, a glide phase and a braking phase, wherein different closing forces prevail just in all three phases. In the acceleration phase and the braking phase the elevator doors are moved with high closing forces, but in the glide phase the elevator doors are moved only with low closing forces. The travel curve is therefore not optimally matched to the pressure relationships, during opening and closing of the elevator doors, through a proportional adaptation of the magnitude of the closing force of the door drive. Thus, an excessively rapid opening and closing of the elevator doors causes an unnecessarily high consumption of electric power and leads to rapid wear of the elevator doors, which in turn increases maintenance costs of the elevator installation and also impairs serviceability of the elevator installation.

SUMMARY OF THE INVENTION

An object of the present invention is to provide a travel curve, which is optimal even under changing pressure relationships, for the opening and closing of elevator doors. This object shall be realized with proven techniques of elevator construction.

The present invention teaches a method of operating an elevator installation, as well as teaches an elevator installation, with elevator doors which are actuated in accordance with a travel curve. Pressure conditions and/or air flows are detected. A travel curve which is optimal with respect to the detected pressure relationships and/or air flows is determined from several travel curves. The advantage of the present invention resides in the fact that the travel curve is optimally determined at all times, thus even in the case of unfavorable physical conditions, such as large pressure fluctuations and/or strong air draft, whereby the level of transport performance of the elevator installation is impaired as little as possible.

Different travel curves are thus used for different pressure relationships and/or air flows. For example, a control of the door drive has at least two different travel curves for opening and closing the elevator doors. One or other travel curve is used depending on the respective physical conditions.

Advantageously the pressure relationships and/or air flows are determined by measuring an air pressure and/or a temperature and/or a wind speed and/or further physical magnitudes in the shaft of the elevator and/or on at least one floor. For example, for this purpose there is present in the shaft and/or on at least one floor a sensor unit which detects the physical conditions. In the case of use of several sensor units different pressure conditions and/or temperatures and/or wind speed and/or physical magnitudes can be detected at several regions in the shaft and/or between the shaft and the floors. In addition, for example, meteorological data such as temperature and/or air pressure and/or wind speed are taken into consideration in the determination of the pressure relationships and/or air flows.

Advantageously the position and/or speed of further elevator cars in the shaft is or are taken into consideration for determination of the pressure relationships and/or air flows. For example the elevator consists of a group of elevator cars which are moved in an open shaft adjacent to one another and/or one above the other and which thereby produce in the shaft changing pressure relationships and/or air flows. The travel curve is optimal at any time through consideration of, inter alia, these unfavorable physical conditions.

Advantageously operational data of a building air conditioning plant and/or of shaft ventilation are taken into consideration for determination of the air flow.

Building specific parameters such as, for example, the height of the building, the number of floors, the quality of the building insulation, the number of open and/or closed entrances and windows, the kind of building roof, etc., are advantageously taken into consideration for determination of the pressure relationships and/or air flow.

In an advantageous refinement of the elevator a target range is defined in which predefined pressure conditions and/or air flows prevail and in which a coupling of an elevator car door folds into the elevator travel position prior to complete locking of an elevator door. Thus, the coupling of the shaft door does not yet have to be separated after complete locking of the elevator door.

In an advantageous embodiment of the elevator a target range is defined in which the predefined pressure relationships and/or air flows prevail and in which departure of the elevator car is possible without the locking of the elevator door being completely concluded. The elevator car thus leaves a floor before the elevator doors are completely locked, which increases transport performance. For this purpose, for example, a coupling disposed between the car door and the shaft door, as well as the door drive, are separately controlled in drive.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
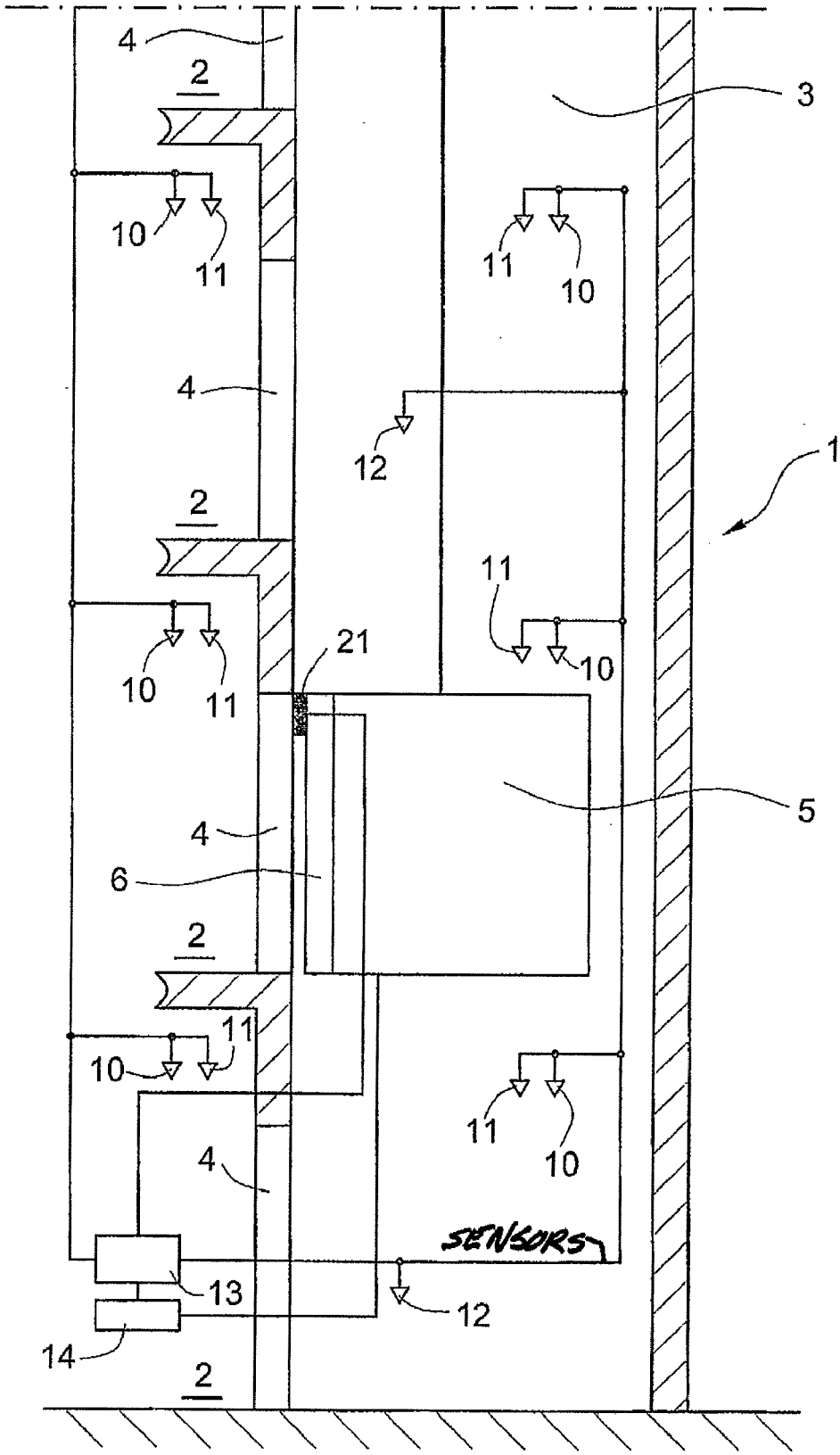
FIG. 1 is a schematic view of a first example of embodiment of an elevator and an elevator car and different sensor units according to the present invention.

With regard to the elevator and the elevator car: FIG. 1 shows a first form of embodiment of the elevator installation, which is arranged in any building and comprises at least one elevator car 5. It can be any known elevator installation 1 which has components such as the elevator car 5 for conveying persons and/or goods in a shaft 3 between floors 2 of the building, as well as a drive for moving the elevator car 5 and an elevator control 14 for controlling the drive.

With regard to the sensor unit: Under certain physical conditions strong air flows can occur in the shaft 3 and hinder movement and, in particular, closing of elevator doors 4, 6. The circumstances under which such phenomena arise are complex. Through detection of, for example, the air pressure at different floors 2 and/or or different positions in the shaft 3 it is possible to determine air flows in parts of the shaft 3 or even in the entire shaft 3. Further sensor units 10 to 12 can detect an air temperature and/or air flows at different locations in the shaft 3 and/or in the building. In addition, local meteorological data, such as temperature and/or air pressure and/or wind speed, can be used in the determination of the pressure relationships and/or air flows. Thus, in the case of a stormy weather forecast an appropriately adapted travel curve can be preventatively determined.

FIG. 1 shows the different sensor units 10 to 12 which are arranged at various locations in the building. The sensor units 10 to 12 detect the most diverse physical conditions such as pressure relationships and/or air flows and/or the air pressure and/or temperature and/or wind speeds, etc. The sensor units 10 to 12 can in that case be commercially available units such as an air pressure sensor 10 (barometer), a temperature sensor 11 (thermometer), a wind speed sensor 12 (anemometer), etc.

There are various methods for measuring the air pressure. For example, the air pressure can be measured with the help of a pressure cell. This can either change its capacitance in dependence on the air pressure or deliver a voltage pulse by way of a piezo crystal. There are different commercially available models which function according to one of the two afore-mentioned forms of measuring. For example, the pressure sensors DC2R5BDC4 and DC010BDC4, both of Honeywell, can be used.

In the case of the temperature measurement, there are various methods for determining the temperature, for example with a resistance thermometer (thermometer with Pt100 sensor, for example W-10144 of Therma or 57101 of Wiesemann & Theis GmbH), or a semiconductor thermometer (thermometer with PTC sensor, for example B59011-C1080-A70 or B59011-C1040-A70 both of EPCOS). There are a number of commercially available models for both methods.

The measurement principle for the wind speed can be not only thermal, for example by wind cooling of a hot wire (for example ATA-30 of ATP Messtechnik GmbH), but also mechanical by measuring the volume flow. The most frequent principle for a wind speed measuring instrument is the cup anemometer or the hydrometric vane anemometer. The cup anemometer detects the wind speed in that a wind wheel of three or four hemispherical cups is driven by the wind, for example the cup anemometer WM30 of Vaisala. In the case of the hydrometric vane anemometer the wind speed sensor is equivalent to a ventilator (for example HGL-4018 of Heinz Hinkel Elektronik).

Figure 2:
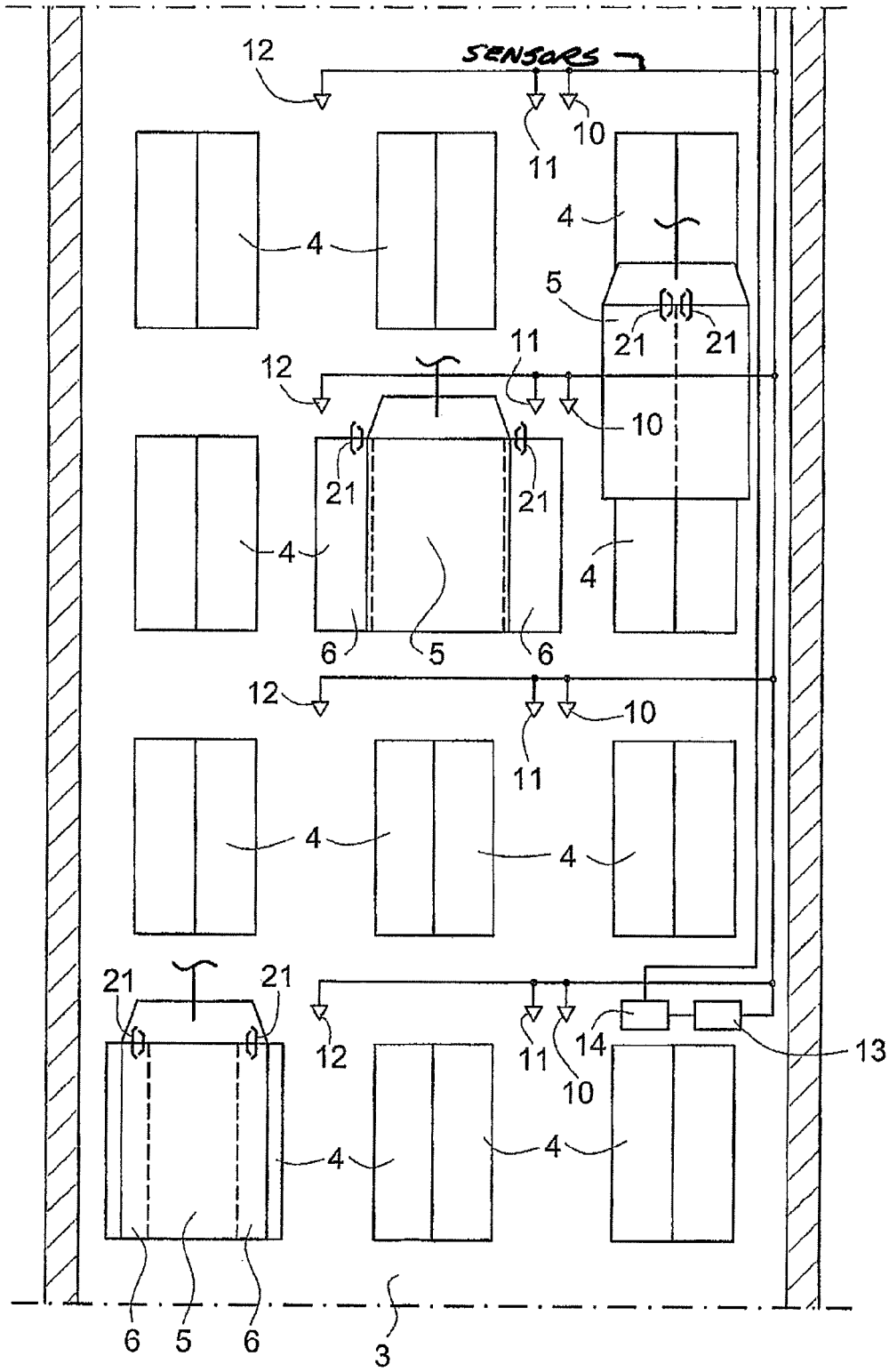
FIG. 2 is a schematic view of a second example of embodiment of an elevator with several elevator cars and different sensor units according to the present invention.

In the case of several elevator cars: The example of embodiment according to FIG. 2 is substantially similar to that according to FIG. 1, so that reference is made to this description and differences with respect thereto are explained in the following. FIG. 2 shows several of the elevator cars 5 each in the shaft 3. In order to detect the numerous physical conditions in the case of several elevator cars 5 in the shaft 3 the position and speed of each elevator car 5 in the shaft 3 is detected by sensors and/or by the elevator control 14. Particularly in the case of a narrow shaft 3 and/or in the case of high speeds of the elevator cars 5 the prevailing physical conditions are complex and pronounced.

Operational data of an air conditioning plant 17 or a shaft ventilation are taken into consideration as further physical conditions. It is assumed that not only the position of the air inlet and air outlet, but also the operating power of the plant, have an influence on the physical conditions of the elevator installation 1. It is conceivable that an emergency control such as, for example, a fire control of a building ventilation, is concomitantly taken into consideration.

With regard to the evaluating unit: The detected signals are communicated as data to an evaluating unit 13. The sensor units 10 to 12 report the detected physical conditions as electrical analog or digital signals by way of connections, advantageously by way of a cable, for example, any building bus, or also by way of electromagnetic waves, for example radio 15, to the evaluating unit 13. Apart from the sensor units 10 to 12, the elevator control 14 also communicates to the evaluating unit 13 data about number, position and speed of the elevator cars 5 in the shaft 3.

Figure 3:
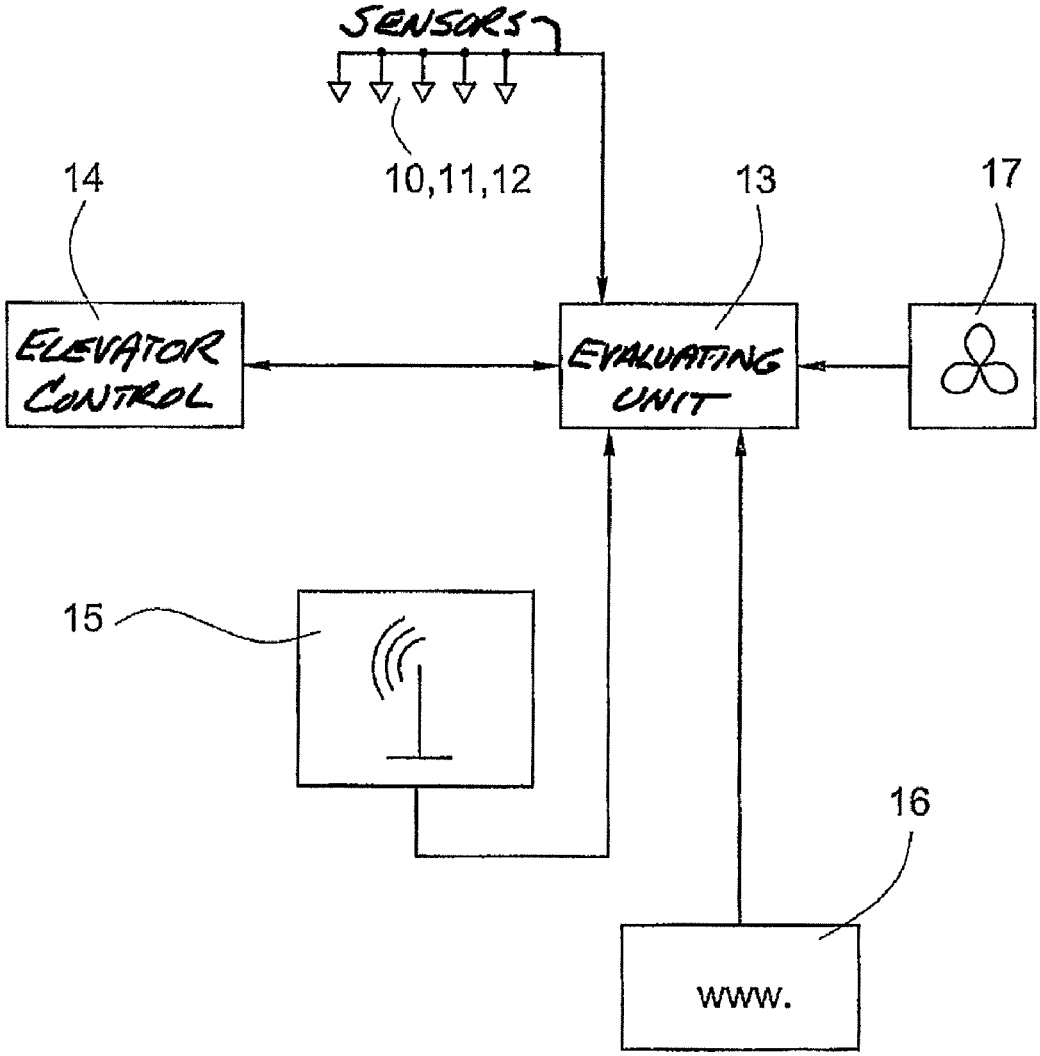
FIG. 3 is a schematic view of an example of embodiment of an evaluating unit, which receives, from different sources, data about the physical conditions, for use in an elevator according to FIG. 1 and/or FIG. 2.

The evaluating unit 13 evaluates these communicated data with respect to a travel curve, which is to be used, for opening and closing the elevator doors 4, 6. FIG. 3 schematically shows the evaluating unit 13 which obtains data about the physical conditions from various sources and determines an optimum travel curve. The evaluating unit 13 is a commercially available device with, for example, inputs for the sensor units 10 to 12 and/or the elevator control 14 and/or a building management system and/or the air conditioning plant 17 and/or the radio receiver 15 and/or an external network, for example an Internet connection 16. The evaluating unit 13 evaluates the data with the help of a processor and a software program. The optimum travel curve can be determined by way of calculations on the basis of the physical conditions. In this case an infinite number of travel curves are available for the elevator doors 4, 6. The optimum travel curve can, however, also be called up from a memory and thus be determined from a finite selection. The optimum travel curve is then communicated to the elevator control 14. Elevator control 14 and evaluating unit 13 can be disposed at different locations or at the same location. The evaluating unit 13 passes on this information to the elevator control 14. The evaluating unit 13 and the elevator control 14 can also be realized in a single apparatus. In addition, it is possible to store the travel curve, which is to be used, in the elevator control 14 and to communicate to the elevator control 14 only information about the travel curve to be used.

Figures 4A, 4B:
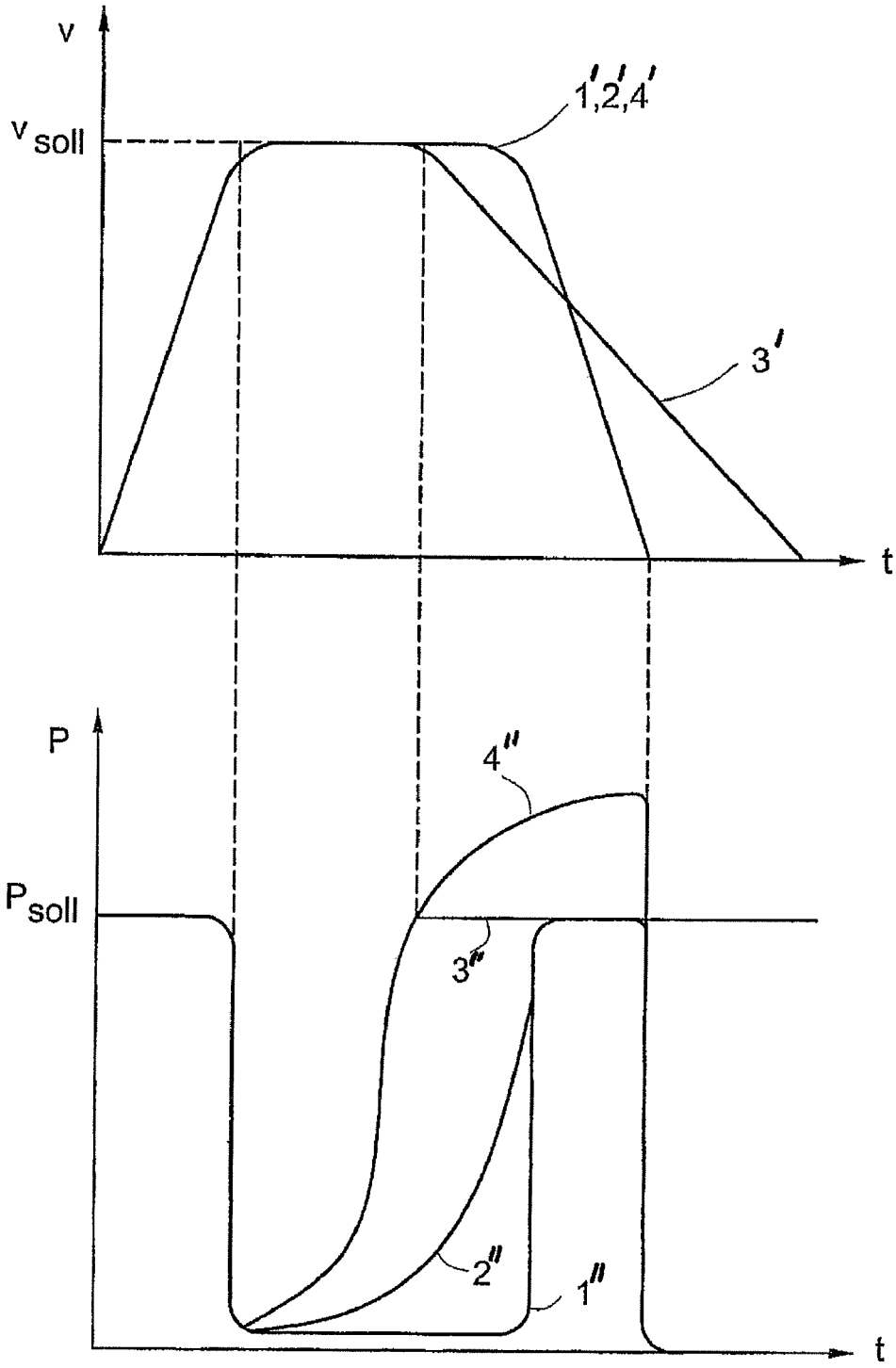
FIGS. 4A and 4B are travel curves for use in an elevator according to FIG. 1 and/or FIG. 2.

Travel curves of the elevator doors as a function of time: FIGS. 4A and 4B show several examples of embodiment of travel curves. A travel curve describes the opening and closing characteristic of the elevator doors 4, 6. The elevator doors 4, 6 consist of at least one car door 6 and, for each floor 2, at least one shaft door 4. The travel curve can be represented in different ways. FIG. 4A shows the speed (V) during opening and closing of the elevator doors 4, 6 as a function of time. FIG. 4B shows the power (P) of door drive 22 during opening or closing of the elevator doors 4, 6 as a function of time. The maximum speed which the elevator doors 4, 6 attain can be dependent on the maximum value of the kinetic energy which the elevator doors 4, 6 may reach for safety reasons. An optimum travel curve makes it possible for the elevator control 14 to lock the elevator doors 4, 6 as quickly as possible and to leave the floor 2 as quickly as possible, even in the case of unfavorable physical conditions. Apart from the physical conditions, also the door drive 22, the mass, the door leaves, etc., play a role in determination of the optimum travel curve.

The closing time of the elevator doors 4, 6 can be reduced by approximately 15 to 20% by an optimum travel curve. The time saved is dependent on the mass of the doors. Depending on the respective ratio of the motor torque and the mass, which is to be moved, of the elevator doors 4, 6 this can vary by plus or minus 10%. This shortened door closing time accumulates in large buildings with many floors 2. For example, for a typical journey of three stops with stop times of eight seconds as well as travel times between two stops of three seconds ((3×8)+(2×3)=34 seconds) roughly 5% of time can be saved in the case of a saving of the door closing time of 0.6 seconds per closing process (3×0.6=1.8 seconds).

A travel curve consists of three phases (I-III). In the acceleration phase (phase I) the elevator doors 4, 6 are accelerated by the target power ($P_{soll}$) of the door drive 22 up to the target speed ($v_{soll}$). In FIG. 4A and FIG. 4B all curves (curves 1'-4') are congruent in the acceleration phase.

In the glide phase (phase II) the elevator doors 4, 6 are in movement, more or less without acceleration, at low drive power. In the case of the curve 1' the phase II with no drive power lasts the longest, since no unfavorable influences disturb the door closing process. In the case of the curve 2' through increase of the drive power up to the value of the target power ($P_{soll}$) the target speed ($v_{soll}$) can be kept to closely. The phase II thereby lasts just as long as in the case of the curve 1'. In the case of the curve 3' notwithstanding increase in the drive power the target speed ($v_{soll}$) cannot be maintained. The phase II without acceleration is prematurely broken off by braking the elevator doors 4, 6 due to unfavorable physical influences. In the case of the curve 4' the drive power is increased above the target power ($P_{soll}$) since it is known that unfavorable physical influences are responsible for the resistance. The curve 4' is accordingly coincident in its closing time with the curves 1' and 2'.

In the braking phase (phase III) the elevator doors 4, 6 are braked again by the motor drive. In that case the curves 1', 2' and 4' have to be braked with equal strength, since their speed at the end of the phase II is always still $v_{soll}$. The curve 3' has a lower speed and thereby the door closing time is increased.

It is conceivable that the three phases occur more or less distinctly in a travel curve. In particular, the phase II may not even be present in the case of certain travel curves. In the case of an optimum travel curve an increased drive power can occur in the glide phase or even the braking phase.

The door drive 22 produces in the normal case (curve 1') the greatest power in terms of amount not only in the acceleration phase (I), but also in the braking phase (III) of the door closing. In addition, an increased drive power in the case of unfavorable physical conditions, for example in the case of poor pressure relationships or strong air flows, is required. In that case initially the drive power is regulated in correspondence with the poor physical conditions up to the maximum power (curve 2'). If this maximum value is reached and the resistance to the car door 6 rises further, then the speed of the car door 6 slows down (curve 3').

The departure of the elevator car 5 takes place as soon as it is ensured that with the kinetic energy currently present in the elevator doors 4, 6 and the available drive power of the door drive 22 a locking of the elevator doors 4, 6 takes place in the time in which the coupling 21, as guide, has still not broken off the mechanical contact with the shaft door 4.

The evaluating unit 13 provides the calculated or stored travel curve. According to the travel curve of the evaluating unit 13 the elevator control 14 reacts to unfavorable physical conditions by increasing the drive power in order to keep the door closing time to an optimum low value. Thus, without placing the safety of persons or things at risk the drive power can be increased above the target value (curve 4') since the cause for the increased power requirement resides in the unfavorable physical conditions and thus is known.

Figure 5A:
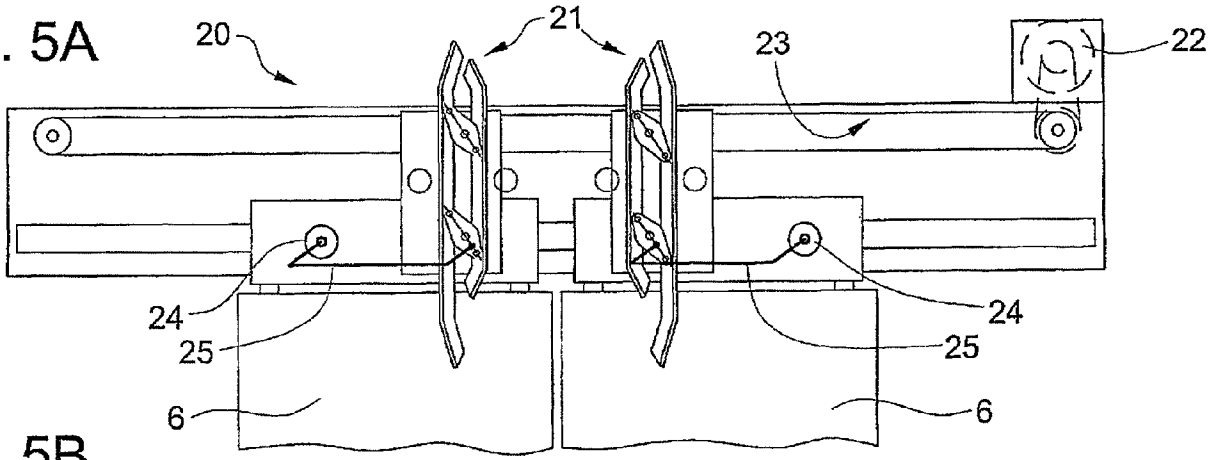
FIGS. 5A and 5B are views of an example of embodiment of an elevator door drive device with controllable coupling and door drive for use in an elevator according to FIG. 1 and/or FIG. 2.
Figure 5B:
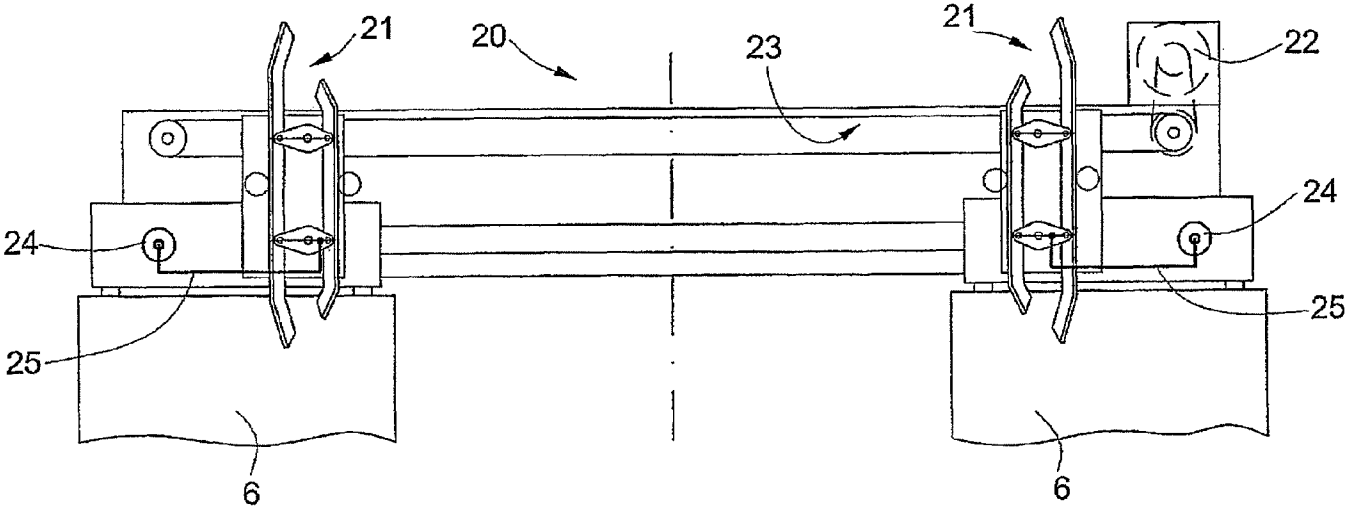

Coupling of an elevator car door: FIGS. 5A and 5B show an example of embodiment of an elevator door drive device 20 with the coupling 21 of the car door 6 to the shaft door 4. The coupling 21 can in that case be moved with the help of a coupling drive 24 by way of a coupling drive means 25 independently of the door drive 22 and the position of the elevator doors 4, 6. Thus, in the case of optimum conditions the couplings 21 can already be folded into the elevator travel position in order at the instant of locking of the elevator doors 4, 6 to begin the departure of the elevator car 5 without delay. In the case of unfavorable external influences the coupling 21 remains mechanically connected with the shaft door 4 until this is locked and only then is folded into the elevator travel position.

The length of the coupling 21 can be such that the departure of the elevator car 5 can already be begun before the elevator doors 4, 6 are completely locked. Since the locking of the shaft door 4 and partly the car door 6 is absolutely necessary for safety reasons the departure of the elevator car 5 can be commenced only if it is ensured that the elevator doors 4, 6 are locked before the coupling 21, as guide, breaks off the mechanical contact with the elevator doors 4, 6.

If a locking of the shaft door 4 up to the instant of the breaking-off of contact is not possible the elevator car 5 must be stopped by an emergency stop. In this case the shaft door 4 is moved into its locked state by the still present mechanical contact of the shaft door 4. It is conceivable that the guide length of the coupling 21 must thus be sufficient so as to be able to cover the travel path for the acceleration as well as also for a possible emergency stop of the premature departure. This means that a mechanical guide contact between the coupling 21 and the shaft door 4 must still be present. In that case the emergency stop can, depending on the respective stopping path available, take place with appropriately adapted acceleration. If the travel curve runs in sub-optimal manner this leads to a prolongation of the door closing times and/or reduction in the level of transport performance of the elevator installation 1.

The drive control of the coupling 21 can take place in different ways; thus the coupling 21 can, for example, be provided with an own coupling drive 24 by way of the coupling drive means 25. It is also conceivable that the coupling 21 is directly mechanically connected with a door drive means 23 and thus is moved by the door drive 22.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of operating an elevator installation, wherein elevator doors are actuated in accordance with a door travel curve, comprising the steps of:

a. detecting at least one of pressure relationships and air flows in the elevator installation; and b. selecting an optimal one of a plurality of predetermined door travel curves based upon the detected at least one of the pressure relationships and the air flows.

2. The method according to claim 1 wherein the at least one of pressure relationships and air flows is detecting by measuring at least one of an air pressure, a temperature and a wind speed in a shaft of the elevator installation or at least one floor of the elevator installation.

3. The method according to claim 1 wherein meteorological data including at least one of temperature, air pressure and wind speed are taken into consideration in the determination of the at least one of pressure relationships and air flows.

4. The method according to claim 1 wherein at least one of position and speed of at least one further elevator car is taken into consideration in the determination of the at least one of pressure relationships and air flows.

5. The method according to claim 1 wherein operating data of at least one of a building air conditioning plant and a shaft ventilation is taken into consideration in the determination of the at least one of pressure relationships and air flows.

6. The method according to claim 1 wherein at least one of a height of a building housing the elevator installation and other building-specific parameters is taken into consideration in the determination of the at least one of pressure relationships and air flows.

7. The method according to claim 1 wherein within a predefined target range of the at least one pressure relationships and air flows a coupling of an elevator car door is folded into an elevator travel position before complete locking of the elevator doors.

8. The method according to claim 1 wherein within a predefined target range of the at least one of pressure relationships and flows an elevator car departs from a floor before complete locking of the elevator doors.

9. The method according to claim 1 wherein a door drive power is readjusted in a braking phase of an elevator door in order to keep a door closing time optimally short.

10. An elevator installation with an elevator door comprising:

a door drive for actuating the elevator door according to a travel curve;

at least one sensor unit for detection of at least one of pressure relationships and air flows in the elevator installation; and an evaluating unit connected to said at least one sensor for determining from a plurality of predetermined travel curves a one of the travel curves which is optimal with respect to the detected at least one of pressure relationships and air flows for controlling said door drive.

11. The elevator installation according to claim 10 wherein said at least one sensor unit determines the at least one of pressure relationships and air flows by measuring at least one of an air pressure, a temperature and a wind speed in a shaft of the elevator installation or at least one floor of the elevator installation.

12. The elevator installation according to claim 10 including a communication link for communicating from an elevator control to said evaluating unit at least one of a position and a speed of at least one further elevator car for use in the determination of the at least one of pressure relationships and air flows.

13. The elevator installation according to claim 10 wherein within a predefined target range of the at least one of pressure relationships and air flows said evaluating unit permits an elevator car to leave a floor before complete locking of the elevator door.

14. An evaluating unit for performing the method steps according to claim 1.

* * * * *